US007935666B2

(12) United States Patent
Rodrigues et al.

(10) Patent No.: US 7,935,666 B2
(45) **Date of Patent: *May 3, 2011**

(54) AMINE COPOLYMERS FOR TEXTILE AND FABRIC PROTECTION

(75) Inventors: Klin A. Rodrigues, Signal Mountain, TN (US); Martin Crossman, Hixson, TN (US)

(73) Assignee: Akzo Nobel N.V., Arnhem (NL)

( * ) Notice: Subject to any disclaimer, the term of this patent is extended or adjusted under 35 U.S.C. 154(b) by 1460 days.

This patent is subject to a terminal disclaimer.

(21) Appl. No.: 11/061,602

(22) Filed: Feb. 18, 2005

(65) Prior Publication Data

US 2005/0148489 A1 Jul. 7, 2005

Related U.S. Application Data

(63) Continuation-in-part of application No. 10/124,358, filed on Apr. 17, 2002, now Pat. No. 6,924,259.

(51) Int. Cl.

| | |
|---|---|
| ***C11D 1/02*** | (2006.01) |
| ***C11D 1/66*** | (2006.01) |
| ***C11D 3/37*** | (2006.01) |
| ***D06M 13/322*** | (2006.01) |

(52) U.S. Cl. ..... 510/341; 510/350; 510/356; 510/433; 510/434; 510/476; 510/477; 510/490; 510/499; 8/115.6; 8/181; 8/196

(58) Field of Classification Search ..... 510/341, 510/350, 356, 433, 434, 476, 477, 490, 499; 8/115.6, 181, 196

See application file for complete search history.

(56) References Cited

U.S. PATENT DOCUMENTS

| | | | | |
|---|---|---|---|---|
| 4,318,956 | A | 3/1982 | Stevens et al. | |
| 5,308,532 | A | 5/1994 | Adler et al. | |
| 6,140,292 | A | 10/2000 | Randall et al. | |
| 6,271,192 | B1 * | 8/2001 | Verstrat et al. | 510/527 |
| 6,573,234 | B1 | 6/2003 | Sivik et al. | |
| 6,924,259 | B2 * | 8/2005 | Rodrigues et al. | 510/476 |
| 2001/0031714 | A1 | 10/2001 | Gassenmeier et al. | |
| 2003/0072950 | A1 | 4/2003 | Rodrigues et al. | |
| 2003/0199419 | A1 * | 10/2003 | Rodrigues et al. | 510/475 |

FOREIGN PATENT DOCUMENTS

| | | |
|---|---|---|
| DE | 43 23 638 A1 | 1/1995 |
| EP | 1 199 326 A2 | 4/2002 |
| WO | WO 95/02674 | 1/1995 |
| WO | WO 99/14297 | 3/1999 |
| WO | WO 00/22075 | 4/2000 |
| WO | WO 00/49124 | 8/2000 |
| WO | WO 00/56849 | 9/2000 |
| WO | WO 03/011969 A1 | 2/2003 |

OTHER PUBLICATIONS

European Search Report for 03008757; Completion Date Aug. 14, 2003.

* cited by examiner

*Primary Examiner* — Brian P Mruk
(74) *Attorney, Agent, or Firm* — James C. Abruzzo

(57) ABSTRACT

The present invention relates to a detergent composition having from 3 to 75 percent by weight of at least one surfactant; and from 0.01 to 5 percent by weight percent of a copolymer composed of from about 70 to 100 mole percent of at least one amine-functional monomer, and from about 30 to 0 mole percent of at least one hydrophobic ethylenically unsaturated monomer, wherein said amine-functional monomer is not a quaternized amine, and wherein said copolymer has been at least partially neutralized. The detergent composition having the copolymers provides color protection and anti-pill properties in laundry applications.

13 Claims, No Drawings

AMINE COPOLYMERS FOR TEXTILE AND FABRIC PROTECTION

CROSS REFERENCE TO RELATED APPLICATIONS

The present application is a continuation-in-part of U.S. Pat. No. 6,924,259, issued Aug. 2, 2005.

BACKGROUND OF THE INVENTION

1. Technical Field

This invention relates to copolymers having amine functionality. More specifically, the present invention relates to homopolymers and copolymers having amine functionality, wherein the polymers contain a substantial degree of neutralization with an organic acid. The polymers are useful in providing color protection in laundry and textile applications.

2. Background Information

Fabrics and textiles can become soiled over time, requiring cleaning. Cleaning these fabrics and textiles removes dirt from the fibers; however, fibers can be dislodged from the woven and knit fabrics or textiles in the process, resulting in lint, fuzz, or pills that can remain on the surface of the material. Not only are fibers lost, the cleaning process can also remove at least some of the dyes, resulting in the fading of the fabric. Both losses are detrimental to the fabric and result in an undesirable appearance.

Detergents, therefore, are formulated with additives designed to associate with the fibers, and diminish the effect of wear, fiber loss, pilling and color-loss. An effective protective additive must (a) have the ability to associate with the surface of the fibers, and not be easily removed, and (b) not adversely effect detergency or cleaning properties of the detergent, i.e., not attract dirt and other soils back onto the fibers.

One method of associating the protective additive to the fiber is to make use of the anionic nature of the fiber. Additives containing cationic moieties are attracted to and associate with anionic fibers, thereby providing some protection to the fibers. Detergents containing linear polyamines are used in laundry detergent applications using this principal. The use of polyamines for this application is described in International Publication Nos. WO 99/14297, WO 00/49124, and U.S. Pat. No. 6,140,292.

International Publication No. WO 00/56849 discloses laundry detergent compositions having cationically charged polymers. The polymers are amine-containing homopolymers, copolymers, or quaternized derivatives thereof. This application maximizes the cationic component of the polymer, thereby increasing association between the polymer and the fibers. Anions are only disclosed in association with quaternized polymers. Unfortunately, cationic polymer additives also attract dirt. Therefore, dirt which has been removed from the laundry is attracted back to the cationic polymer and thus back to the clothes.

Another approach for associating a polymeric protective additive with fibers is to utilize the relative hydrophobic nature of the fibers compared to the aqueous environment of the wash liquor. Hydrophobic polymers associate with fibers and minimize exposure to the aqueous environment. On the other hand, polymers having a high hydrophilic character, such as many of the polyamines and poly amino acids described in the art, associate with the aqueous wash liquor, and do not deposit well onto the surface of the fibers. One way to overcome this disadvantage is to form a polymer having quaternized amines, such as is disclosed in International Publication No. WO 00/22075. These polymers have a high hydrophilic character, but are attracted to fibers due to the strong cationic character. The negative side of the high cationic character is the attraction for dirt and thus poor redeposition properties.

Polymers having a high degree of hydrophobicity are difficult to synthesize since they tend to be water insoluble and come out of solution when placed into an aqueous solution. The solubility of the polymer can be improved by reducing the level of hydrophobe; however, this also reduces the positive fiber deposition properties associated with the hydrophobe.

Polymers having a high degree of hydrophobicity are described in U.S. Publication No. 2003/00720950. The hydrophobically modified solution polymers can be used to provide color protection and anti-pilling properties to fabrics and textiles. The polymers contain at least 75 mole percent (mol %) of the hydrophobic monomer, and the hydrophobic amine monomer is neutralized to improve solubility.

Still, there is a need for a polymeric additive useful in protecting fibers during the cleaning process and having the proper balance between hydrophilic, hydrophobic, and cationic components, thereby providing excellent protective properties to fibers while minimizing the negative effect on redeposition properties associated with cationic character. While not being bound to any theory, it is believed that the hydrophobe serves to minimize the interaction of the amine functionality with surfactants typically found in a detergent. The copolymer should balance the water solubility (amine groups) and the water insolubility (hydrophobic groups) on the polymer molecule in order to optimize desired properties.

SUMMARY OF THE INVENTION

It has been found that amine functional copolymers that are at least partially neutralized and have greater than about 20 mol % of the amine moiety, balanced with a suitable level of nonionic and/or hydrophobic moieties, provide the advantage of color and wear protection to fibers with a minimum of negative effects on redeposition properties.

It has further been found that an amine functional (co) polymer having greater than 70 mol % of the amine moiety, wherein at least 75 mol % of the amine moiety has been neutralized with a suitable organic acid, provides the advantage of color and wear protection to fibers with a minimum of negative effects on redeposition properties.

Accordingly, the present invention is directed to a detergent composition having from about 3 to about 75 percent by weight of the total composition of at least one surfactant and from about 0.01 to about 5 percent by weight of the total composition of at least one copolymer. The copolymer is formed from about 70 to 100 mol %, based on the total mol % of the copolymer, of at least one amine-functional monomer, from 0 to about 30 mol %, based on the total mol % of the copolymer, of at least one hydrophobic ethylenically unsaturated monomer, from 0 to about 30 mol %, based on the total mol % of the copolymer, of an hydroxy functional ethylenically unsaturated monomer, and from 0 to about 10 mol %, based on the total mol % of the copolymer, of a diethylenically unsaturated monomer or polyfunctional mercaptan. The amine-functional monomer used in forming the copolymer is not a quaternized amine. The copolymer has been at least 75 mol % neutralized with an organic acid. In other embodiments, the copolymer can also be formed from additional monomers such as 0 to about 30 mol %, based on the total mol % of the copolymer, of an acid functional monomer, and 0 to about 10 mol %, based on the total mol % of the copolymer, of a hydroxy, alkyl or aromatic capped poly(alkoxylated) monomer.

The invention is also directed to a woven or knit natural fibrous material that is coated on at least one side with a copolymer formed from about 70 to 100 mol %, based on the total mol % of the copolymer, of at least one amine-functional monomer, from 0 to about 30 mol %, based on the total mol % of the copolymer, of at least one hydrophobic ethylenically unsaturated monomer, from 0 to about 30 mol %, based on the total mol % of the copolymer, of an hydroxy functional ethylenically unsaturated monomer, and from 0 to about 10 mol %, based on the total mol % of the copolymer, of a diethylenically unsaturated monomer or polyfunctional mercaptan. The amine-functional monomer used in forming the copolymer is not a quaternized amine. The copolymer can further be formed from additional monomers such as from 0 to about 30 mol %, based on the total mol % of the copolymer, of an acid functional monomer and from 0 to about 10 mol %, based on the total mol % of the copolymer, of a hydroxy, alkyl or aromatic capped poly(alkoxylated) monomer.

DETAILED DESCRIPTION OF THE INVENTION

The present invention relates to a copolymer that is synthesized from at least one amine-functional monomer, and from at least one hydrophobic ethylenically unsaturated monomer.

Amine functional monomers useful in the invention include mono-, di-, tri-, and multi-amines. Examples of useful amine monomers include, but are not limited to N,N-dialkyl aminoalkyl (meth)acrylate, N,N-dialkyl aminoalkyl acrylate, dialkyl aminoalkyl (meth)acrylamide and N,N-dialkyl aminoalkyl acrylamide, where the alkyl groups are independently $C_{1-18}$. Aromatic amine containing monomers such as vinyl pyridine may also be used. One skilled in the art will also be able to incorporate an amine functionality by reaction with a polymerizable anhydride (e.g., maleic anhydride), epoxide (e.g., glycidyl methacrylate), trans-esterification or condensation esterification or amidation. Furthermore, monomers such as vinyl formamide, vinyl acetamide, and the like which generate amine moieties on hydrolysis may also be used. In one embodiment the hydrophilic acid-neutralizable monomer is N,N-dimethyl aminoethyl methacrylate, N,N-dimethyl aminopropyl methacrylamide, or a mixture thereof. The amine does not include quaternary amines. It has been found that quaternary amines produce unsatisfactory redeposition properties. The copolymer is formed from about 70 to about 100 mol %, based on the total mol % of the copolymer, of the amine-functional monomer, which is neutralized to at least 75 mol % of the available amine with an organic acid.

The organic acid can be any weak acid containing a carbon atom. In one embodiment, the organic acids are carboxylic acids. In a further embodiment, the organic acids are polyfunctional acids. Examples of useful organic acids include but are not limited to; formic, acetic, propionic butyric, valeric, hexanoic, heptanoic, octanoic, nonanoic, decanoic, lauric, myristic, palmitic, stearic, oleic, linoleic, crotonic, maleic, fumaric, trifluoroacetic, glycolic, lactic, hydroxybutyric, malic, tartaric, gluconic, glyoxilic, pyruvic, benzoic, oxalic, citric, adipic, malonic, succinicglutaric, pimelic, suberic, azelaic, sebacic, polymaleic, polyacrylic.

The hydrophobic monomer can be any ethylenically unsaturated monomer known in the art, or a mixture thereof Examples of such monomers include, but are not limited to: (meth)acrylates, maleates, (meth)acrylamides, vinyl esters, itaconates, styrenics, unsaturated hydrocarbons and acrylonitrile, nitrogen functional monomers, vinyl esters, alcohol functional monomers, unsaturated hydrocarbons, and alkoxylated $C_8$-$C_{22}$ (meth)acrylates. Preferred hydrophobic monomers are vinyl monomers and acrylate monomers such as methyl methacrylate, ethyl acrylate, and butyl acrylate. The copolymer is formed from about 0 to about 30 mol % of the hydrophobic monomer.

In addition to the amine-functional monomer(s) and the hydrophobic monomer(s) the polymer of the invention may contain other monomeric units as known in the art, including, but not limited to, up to 30 mole percent based on the total mol % of the copolymer, of an hydroxy functional ethylenically unsaturated monomer, up to 10 mol %, based on the total mol % of the copolymer, of a diethylenically unsaturated monomer or a polyfunctional mercaptan, and/or up to 20 mol %, based on the total mol % of the copolymer, of a mono- or di-carboxylic acid monomer, up to 10 mole percent of an of a hydroxy, alkyl or aromatic capped poly(alkoxylated) monomer, or any combination thereof.

Small amounts of crosslinking monomer can be included in the polymer. If crosslinking monomers are used, preferably they form more flexible crosslinks, such as with polyethylene glycol diacrylate.

The copolymer is synthesized by solution polymerization techniques. The process involves polymerizing at least one amine-functional monomer and at least one hydrophobic ethylenically unsaturated monomer in a non-aqueous solvent, or non-aqueous/aqueous solvent mixture; forming an aqueous polymer dispersion; and adding an aqueous acid to at least partially neutralize the copolymer such that it becomes water soluble. The addition of the acid can occur either before, after, or during the formation of the aqueous polymer dispersion from the non-aqueous polymer solution.

The polymers formed from this type of process are generally random copolymers. However, other polymer architectures such as block, star etc may also be used. The special techniques used to synthesize these various types of polymer architecture are well known in the art.

The polymerization of the monomers in a non-aqueous solvent can be done by any means known in the art. The solvent should be miscible with water. Preferably the solvent is capable of forming an azeotrope with water. Examples of solvents useful in the present invention include, but are not limited to, alcohols such as methanol, ethanol, and isopropyl alcohol; glycol ethers; and acetone. If the solvent is a low boiling solvent, such as an alcohol or acetone, it can be stripped from the solution.

The final aqueous polymer composition can be formed by the combination of the conversion of the polymer solution to an aqueous solution and the addition of an acid. This results in a composition that can be either clear or hazy.

The amine copolymer can be combined with surfactants and other components known in the art. Useful surfactants are anionic, nonionic or a combination thereof.

Examples of suitable anionic surfactants include alkylaryl sulfonates, alkylaryl sulfonic acids, diphenyl sulfonates, ethoxylated fatty acids, olefin sulfonates, phosphate esters, propoxylated fatty acids, sulfates and sulfonates of fatty acids, sulfates and sulfonates of ethoxylated alkyl phenols, sulfates of alcohols, sulfates of ethoxylated alcohols, sulfates of fatty esters, sulfonates of dodecyl or trodecyl benzenes, and sulfosuccinamates.

Examples of suitable nonionic surfactants include alcohols, alkanolamides, ethoxylated alcohols, ethoxylated alkyl phenols, ethoxylated fatty esters and oils, fatty esters, glycerol esters, glycol esters, imidazolines, lanolin derivatives, monoglycerides, sorbitan esters, sucrose and glucose esters, Ingredients such as surfactants can be used in combination with the copolymer in formulating detergent compositions. The detergent composition is preferably a laundry composition and can be in the form of granules, extrudates, flakes, tablets, liquids, gels, discrete doses or pastes.

The detergent composition can include about 3 to about 75 percent by weight of the total composition of surfactant(s), 0 to 55 percent by weight of the total composition builder(s), and about 15 to about 95 percent by weight of the total composition of a combination of optional ingredients, such as buffers, enzymes, softeners, antistatic agents, fluorescers, dyes, perfumes, water and fillers. The amine copolymer is used in amount of from about 0.01 to about 5.0 percent of the total composition. In another aspect, the copolymer is used in amount of from about 0.01 to about 2.5 percent. In even another aspect, the copolymer is used in amount of from about 0.1 to about 2 percent by weight of the detergent formulation.

Other optional components of the detergent formulations include, but are not limited to, ion exchangers, alkalis, anticorrosion materials, anti-redeposition materials, optical brighteners, fragrances, dyes, fillers, chelating agents, enzymes, fabric whiteners and brighteners, sudsing control agents, solvents, hydrotropes, bleaching agents, bleach precursors, buffering agents, soil removal agents, soil release agents, fabric softening agent and opacifiers.

In a laundering process, the detergent composition is applied to a fibrous material in an aqueous medium. The fibrous material can be a woven or knit fabric composed of natural fibers, synthetic fibers, or a mixture thereof. In one embodiment, the fibrous material is formed from natural fibers such as cotton, wool or silk.

In a textile finishing process, the amine copolymer contacts the textile by padding or immersion process, an exhaustion process, or other processes known in art. The amine copolymer provides anti-pilling and color protection to the textile or fabric. Textiles such as carpet can be treated with the amine polymer, either as an initial or subsequent treatment.

The hydrophobically modified amine copolymer is also useful as an additive to hard surface cleaners where they improve cleaning and extend the time interval between cleaning, in autodish applications to minimize filming or spotting on glassware. Additionally, the polymers have good film forming properties making them useful for coating or encapsulating an active ingredient that may be released by dissolution in water or triggered by a change in pH.

The following examples are presented to further illustrate and explain the present invention and should not be taken as limiting in any regard. All percentages are based on mole and not weights.

Example 1

DMAEMA/MMA 30/70

To a 2 liter glass vessel equipped with; reflux condenser, stirrer, means of temperature control, 400 g water and 300 g propan-2-ol were charged then heated to a gentle reflux. A monomer mixture of dimethyl aminoethyl methacrylate (106.6 g) and methyl methacrylate (160 g) was fed into the reactor over an approximate timeframe of 3 hours. Sodium persulfate solution (8.7 g in 125 g of water) was fed concurrently with the monomer over a similar time period. When feeds were complete acetic acid solution (36.6 g in 150 g water) was fed into the reactor. A propan-2-ol azeotrope was then distilled from the reactor.

Example 2

DMAEMA/EA 30/70

To a 2 liter glass vessel equipped with; reflux condenser, stirrer, means of temperature control, 300 g deionized water and 300 g propan-2-ol were charged then heated to a gentle reflux. A monomer mixture of dimethyl aminoethyl methacrylate (134.6 g) and ethyl acrylate (200 g) was fed into the reactor over an approximate timeframe of 3 hours. Sodium persulfate solution (3.4 g in 125 g of water) was fed concurrently with the monomer over a similar time period. When feeds were a propan-2-ol azeotrope was then distilled from the reactor, followed by neutralization with acetic acid (41.2 g).

Example 3

DMAEMA/MMA 40/60

To a 2 liter glass vessel equipped with; reflux condenser, stirrer, means of temperature control, 400 g water and 300 g propan-2-ol were charged then heated to a gentle reflux. A monomer mixture of dimethyl aminoethyl methacrylate (143.1 g) and methyl methacrylate (136.7 g) was fed into the reactor over an approximate timeframe of 3 hours. Sodium persulfate solution (8.7 g in 110 g of water) was fed concurrently with the monomer over a similar time period. When feeds were complete, hydrochloric acid solution (79.6 g of 37.6% active in 100 g water) was fed into the reactor. Residual monomers were scavenged over a 1 hour timeframe with sodium persulfate (1.5 g in 30 g of water). A propan-2-ol azeotrope was then distilled from the reactor with the aid of a defoaming agent (Foamblast 552 (0.16 g) available from Ross Chem. Inc.). Distillate was replaced w/w with water during distillation.

Example 4

DMAEMA/MMA 50/50

To a 2 liter glass vessel equipped with; reflux condenser, stirrer, means of temperature control, 400 g water and 300 g propan-2-ol were charged then heated to a gentle reflux. A monomer mixture of dimethyl aminoethyl methacrylate (177.7 g) and methyl methacrylate (114.3 g) was fed into the reactor over an approximate timeframe of 3 hours. Sodium persulfate solution (8.7 g in 110 g of water) was fed concurrently with the monomer over a similar time period. When feeds were complete, hydrochloric acid solution (90 g of 32% active in 100 g water) was fed into the reactor. Residual monomers were scavenged over a 1 hour timeframe with sodium persulfate (1.5 g in 30 g of water). A propan-2-ol azeotrope was then distilled from the reactor with the aid of a defoaming agent (Foamblast 552 (0.16 g) available from Ross Chem. Inc.). Distillate was replaced w/w with water during distillation.

Example 5

DMAEMA/MMA 30/50/20

To a 2 liter glass vessel equipped with; reflux condenser, stirrer, means of temperature control, 400 g water and 300 g propan-2-ol were charged then heated to a gentle reflux. A monomer mixture of dimethyl aminoethyl methacrylate (106.6 g) and methyl methacrylate (113.9 g) and hydroxypropyl methacrylate (65.6 g) was fed into the reactor over an approximate timeframe of 3 hours. Sodium persulfate solution (8.7 g in 110 g of water) was fed concurrently with the monomer over a similar time period. When feeds were complete, hydrochloric acid solution (62.7 g of 37.6% active in 100 g water) was fed into the reactor. Residual monomers were scavenged over a 1 hour timeframe with sodium persulfate (1.5 g in 30 g of water). A propan-2-ol azeotrope was then distilled from the reactor with the aid of a defoaming agent (Foamblast 552 (0.16 g) available from Ross Chem. Inc.). Distillate was replaced w/w with water during distillation.

Example 6

DMAEMA/MMA/HBMA 30/50/20

To a 2 liter glass vessel equipped with; reflux condenser, stirrer, means of temperature control, 400 g water and 300 g propan-2-ol were charged then heated to a gentle reflux. A monomer mixture of dimethyl aminoethyl methacrylate (106.6 g) and methyl methacrylate (113.9 g) and hydroxybutyl methacrylate (72.0 g) was fed into the reactor over an approximate timeframe of 3 hours. Sodium persulfate solution (8.7 g in 110 g of water) was fed concurrently with the monomer over a similar time period. When feeds were complete, hydrochloric acid solution (62.7 g of 37.6% active in 100 g water) was fed into the reactor. Residual monomers were scavenged over a 1 hour timeframe with sodium persulfate (1.5 g in 30 g of water). A propan-2-ol azeotrope was then distilled from the reactor with the aid of a defoaming agent (Foamblast 552 (0.16 g) available from Ross Chem Inc.). Distillate was replaced w/w with water during distillation.

Example 7

Color Protection Properties of the Polymer of Example 4

A color protection evaluation was performed using lab-produced liquid built detergent. A base-line sample was run with the complete detergent and no polymer, then a control, which consisted of the complete detergent and the polymer of Example 4. The test was then designed to omit one component from the detergent for each of the runs, but included the same polymer in each. Swatches of seven different colors were washed in each of the detergent combinations, and the Delta E (difference in color after washing) was calculated after five complete wash/dry cycles.

Liquid Built Detergent (LBD) Formulation:

| Ingredient | % Wet |
|---|---|
| DI Water | 37.25 |
| Sodium Citrate | 9.0 |
| Propylene Glycol | 8.0 |
| Sodium Xylene Sulfonate | 18.75 |
| Biosoft D-40 | 20.0 |
| Neodol 25-9 | 7.0 |

Test Conditions—

Five cycles, including tumble dry after each 100 g/load liquid detergent

110° F., 10 minute wash/cold rinse

1% polymer in all cycles (except control)

10 ballast pillowcases

TABLE 1

| | Delta E after 5 cycles | |
|---|---|---|
| Detergent Sample | Direct Blue 71 | Direct Black 22 |
| Control (no polymer) | 3.63 | 15.10 |
| Base LBD | 1.12 | 3.08 |
| w/o sodium citrate | 0.84 | 3.48 |
| w/o propylene glycol | 1.06 | 3.52 |
| w/o SXS | 1.00 | 4.57 |
| w/o Biosoft | 0.74 | 0.8 |
| w/o Neodol 25-9 | 0.97 | 3.42 |

Example 8

Anti-Pilling Testing

The anti-pilling tests were conducted as follows. The test was conducted over 5 or 10 full cycles using 118 g/load Xtra liquid detergent and 1% active polymer on detergent. The wash temperature was 93° F., with a 10-minute wash and a cold rinse. The wash water was Chattanooga City water, which typically has a hardness of 70 ppm. 3 black knit swatches (Cotton Interlock knit TIC 460 from Textile innovators) and 3 white swatches (Bleached Cotton Interlock knit TIC 460 from Textile innovators) were attached to one pillowcase and 10 ballast pillowcases were used as ballast. The white knit swatches were used to visually evaluate pilling, and the black knit swatches were used to evaluate color protection using a spectrophotometer.

TABLE 2

| | Pilling Resistance Evaluation | | Delta E |
|---|---|---|---|
| Sample | 5 cycles | 10 cycles | (Black Fabric) |
| Control | poor | poor | 18.33 |
| Polymer of Example 1 | very good | fair | 10.45 |
| Polymer of Example 5 | very good | very good | 9.60 |
| Polymer of Example 6 | good | good | 9.22 |

Example 9

Anti-Pilling Performance of DMAEMA/MMA

The copolymer of Example 1 (dimethyl aminoethyl methacrylate (DMAEMA)-co-methyl methacrylate (MMA) (70 mol %)) was found to have excellent anti-pilling performance. Therefore, several evaluations were run on this polymer to determine if it would adversely affect laundry performance. Each evaluation is described below and followed by the results.

TABLE 3

| | Whiteness Index | | | |
|---|---|---|---|---|
| | A&H Liquid detergent | | A&H Powder detergent | |
| Sample | Before wash | After wash | Before wash | After wash |
| Control | 80.20 | 109.12 | 80.50 | 110.02 |
| Example 1 | 79.61 | 108.87 | 80.76 | 108.39 |

Optical Brightener Deposition Test Conditions -
1.6 g/L Arm & Hammer powder or liquid detergent
1% polymer, where indicated
110 ppm $H_2O$, 80 rpm, 34° C. (93.4° F.)
4 white cotton swatches The polymer did not significantly interfere with optical brightener deposition.

TABLE 4

| Sample | Average % Soil Release |
|---|---|
| Control | 68.64 |
| Example 1 | 70.28 |

Stain Removal Test Conditions -
1.7 g/L Xtra detergent
1% polymer, where indicated
110 ppm $H_2O$, 80 rpm, 34° C. (93.4° F.)
3 white cotton swatches for test, one for ballast
3 pre-wash cycles, Ragu stain and overnight dry
Final wash includes polymer Some small improvement in stain release was realized with the addition of the polymer.

TABLE 5

| | Delta E after washing | |
|---|---|---|
| Fabric Swatch | Control | Example 1 |
| Direct Black | 1.95 | 1.04 |
| Direct Blue 80 | 2.28 | 1.40 |
| Direct Orange 39 | 1.91 | 1.55 |
| Direct Blue 86 | 1.06 | 0.34 |
| Direct Red 243 | 0.71 | 0.82 |

Color Protection Test Conditions -
118 g/Load (full scale) Xtra liquid detergent
1% polymer, where specified
City $H_2O$, 10 minute wash, 34° C. (93° F.)
One direct dyed swatch of each color attached to ballast fabric The data in the Table indicates that the Example 1 copolymer has color protection properties in addition to anti-pilling properties. In addition, it can be used as a control release agent that is insoluble in the wash cycle but soluble in the rinse, thus delivering actives in the rinse.

Example 10

Comparative

The polymers tested are listed in the Table below.

TABLE 6

| | | Delta Whiteness Index | |
|---|---|---|---|
| Sample | Polymer description | Cotton | Poly/Cotton |
| Control | | 20.33 | 7.32 |
| Comparative | Homopolymer of DMDAAC | 28.03 | 31.47 |

TABLE 6-continued

| | | Delta Whiteness Index | |
|---|---|---|---|
| Sample | Polymer description | Cotton | Poly/Cotton |
| Comparative | Homopolymer of DMAEMA | 30.62 | 21.88 |
| Example 1 | DMAEMA-MMA (70 mole %) | 21.61 | 9.93 |

Soil Anti-Redeposition Test Conditions -
2 wash/dry cycles
1.7 g/L Xtra liquid detergent
1% polymer
0.9 grams bandy black,
150 ppm $H_2O$, 80 rpm, 93.4° F.
10 minute wash, 3 minute rinse
3 EMPA 213, 3 419W cotton, 3 #400 cotton (as ballast)

The data in the Tables indicate that the homopolymer of DMDAAC and DMAEMA have very poor anti-redep performance. However, a hydrophobically modified amine polymer does not adversely affect anti-redep performance.

Example 11

Hard Surface Cleaning Formulations

Acid Cleaner

| Ingredient | wt % |
|---|---|
| Citric acid (50% solution) | 12.0 |
| C12-15 linear alcohol ethoxylate with 3 moles of EO | 5.0 |
| Alkylbenzene sulfonic acid | 3.0 |
| Polymer of Example 3 | 1.0 |
| Water | 79.0 |

Alkaline Cleaner

| Ingredient | wt % |
|---|---|
| Water | 89.0 |
| Sodium tripolyphosphate | 2.0 |
| Sodium silicate | 1.9 |
| NaOH (50%) | 0.1 |
| Dipropylene glycol monomethyl ether | 5.0 |
| Octyl polyethoxyethanol, 12-13 moles EO | 1.0 |
| Polymer of Example 4 | 1.0 |

Example 12

Automatic Dishwash Formulation

| Ingredients | wt % |
|---|---|
| Sodium tripolyphosphate | 25.0 |
| Sodium carbonate | 25.0 |
| C12-15 linear alcohol ethoxylate with 7 moles of EO | 3.0 |
| Polymer of Example 4 | 4.0 |
| Sodium sulfate | rest |

Example 13

Car Wash Rinse Off Aid Formulation

| Ingredients | wt % |
|---|---|
| Water | 80 |
| Butyldiglycol | 10 |
| Polymer of Example 4 | 10 |

Example 14

Film Forming

Polymers from Examples 2, 3 and 6 were cast onto a polyethylene surface and left to dry at room temperature.

TABLE 7

| Polymer | Film |
|---|---|
| Example 2 | Good, tacky, elastic |
| Example 3 | Good, flexible slightly brittle |
| Example 6 | Poor, brittle |

The above films prepared from the polymers of Examples 2, 3 and 6 are soluble in water.

Example 15 pH Solubility of Example 1

The polymer of Example 1 was diluted to a 1% solution. The pH was adjusted with 2% NaOH solution.

TABLE 8

| pH of Solution | Appearance |
|---|---|
| 2.5 | Clear |
| 6.0 | Clear |
| 7.8 | cloudy |

Example 16 pH Solubility of the Polymer of Example 3

The polymer of Example 3 was diluted to a 1% solution. The pH was adjusted with 2% NaOH solution.

TABLE 9

| pH of Solution | Appearance |
|---|---|
| 3.0 | Clear |
| 7.9 | Clear |
| 8.4 | cloudy |

Example 17 pH Solubility of the Polymer of Example 6

The polymer of example 6 was diluted to a 1% solution. The pH was adjusted with 2% NaOH solution.

TABLE 10

| pH of Solution | Appearance |
|---|---|
| 2.9 | Clear |
| 6.4 | Clear |
| 7.0 | Slight precipitate |
| 7.5 | Cloudy |

Example 18

Synthesis of Citric Acid Neutralized (Poly)DMAEMA

Water (200 g) and citric acid (96 g, 0.5 mol) were added to a 1 liter glass reactor equipped with means of stirring, temperature control and reflux condenser. The reactor contents were heated to 90° C. Dimethylaminoethyl methacrylate (DMAEMA, 78.8 g, 0.5 mol) was fed into the reactor over a period of 2.5 hours. Separately and concurrently with the DMAEMA, an aqueous solution of sodium persulfate (3 g) was fed into the reactor over a period of 3 hours. The polymerization was scavenged with sodium persulfate (1 g) aqueous feed for one additional hour.

Example 19

Color Protection Assessment of the Polymer of Example 18

Color Protection Assessment Test Conditions—
- 6 cycles, full scale washes
- 10 minute cycle, regular wash, standard rinse
- City water at 93° F., medium setting
- 8 ballast pillowcases, 1 bath towel
- 3 black knit swatches attached to pillowcase
- 100 g Purex liquid detergent
- 1% polymer wher specified

TABLE 11

| Sample | Avg. Delta E | Avg. Delta L |
|---|---|---|
| Control | 11.12 | 7.02 |
| Example 18 | 4.82 | 1.58 |

The results demonstrate that the polymer of Example 18 ((poly)DMAEMA) has excellent color protection properties.

Example 20

Anti Redeposition Test for Polymer of Example 18

Anti Redeposition Test Conditions—
- 3 cycles
- 100 g liquid built detergent
- 1% polymer
- 150 ppm $H_2O$, 93° F., 10 minute wash
- 3 cotton, 3 poly/cotton swatches
- 8 ballast pillowcases
- ASTM method

TABLE 12

| Sample | Average Delta E | | Average Delta WI CIE | |
|---|---|---|---|---|
| | Cotton | Poly/cotton | Cotton | Poly/cotton |
| Control | 2.1 | 2.2 | 6.0 | 7.7 |
| Example 18 | 2.5 | 2.3 | 7.2 | 6.5 |

The above results illustrated that the fully neutralized polyamine has little effect on soil redeposition.

Example 21

Comparative

Soil Anti-Redepositon Test Conditions
2 wash/dry cycles
10 minute wash, 3 minute rinse
150 ppm $H_2O$, 80 rpm, 93.4° F.
1.7 g/L Xtra liquid detergent
0.9 grams bandy black
3 EMPA 213, 3 419W cotton, 3 #400 cotton (as ballast)

TABLE 13

| Sample | Polymer description | Delta Whiteness Index | |
|---|---|---|---|
| | | Cotton | Poly/Cotton |
| Control | | 20.33 | 7.32 |
| Comparative | pDMAEMA - 50% neutralized | 30.62 | 21.88 |

The above results illustrates that the partially neutralized polymer of Example 18 ((poly)DMAEMA) negatively impacts cleaning.

Although the present invention has been described and illustrated in detail, it is to be clearly understood that the same is by way of illustration and example only, and is not to be taken as a limitation. The spirit and scope of the present invention are to be limited only by the terms of any claims presented hereafter.

What is claimed is:

1. A detergent composition comprising:
from 3 to 75 percent by weight of at least one anionic or nonionic surfactant; and
from 0.01 to 5 percent by weight of a copolymer having
from 80 to 100 mole percent of at least one amine-functional monomer;
from 0 to 30 mole percent of at least one hydrophobic ethylenically unsaturated monomer;
from 0 to 30 mole percent of an hydroxy functional ethylenically unsaturated monomer; and
from 0 to 10 mole percent of a diethylenically unsaturated monomer or polyfunctional mercaptan;
wherein said amine-functional monomer is not a quaternized amine, and
wherein said copolymer has been at least 75 mol % neutralized with an organic acid.

2. The copolymer of claim 1 wherein said amine functional monomer is selected from the group consisting of N,N-dialkylaminoalkylmethacrylate, N,N-dialkylaminoalkylacrylate, dialkylaminoalkylmethacrylamide, and N,N-dialkylaminoalkylacrylamide, where the alkyl groups are independently $C_{1-18}$ and combinations thereof.

3. The copolymer of claim 1 wherein said amine functional monomer is selected from the group consisting of N,N-dimethylaminoethylmethacrylate, N,N-dimethylaminopropylacrylamide and combinations thereof.

4. The copolymer of claim 1 wherein said hydrophobic ethylenically unsaturated monomer is selected from the group consisting of (meth)acrylates, maleates, (meth)acrylamides, vinyl esters, itaconates, styrenics, unsaturated hydrocarbons and acrylonitrile, nitrogen functional monomers, vinyl esters, alcohol functional monomers, unsaturated hydrocarbons, and $C_8$-$C_{22}$ alkoxylated (meth)acrylates and mixtures thereof.

5. The detergent composition of claim 1 comprising from 0.1 to 2.0 weight percent of said copolymer.

6. The detergent composition of claim 1 wherein the organic acid comprises citric acid, glycolic acid, oxalic acid, lactic acid or combinations thereof.

7. The copolymer of claim 1 further comprising from 0 to 30 mole percent of an acid functional monomer.

8. The copolymer of claim 1 further comprising from 0 to 30 mole percent of an hydroxyalkyl or aromatic capped poly (alkoxylated) monomer.

9. A fibrous material comprising:
a woven or knit natural fibrous substrate; and
a protective coating having a copolymer having
from 80 to 100 mole percent of at least one amine-functional monomer;
from 0 to 30 mole percent of at least one hydrophobic ethylenically unsaturated monomer,
from 0 to 30 mole percent of an hydroxy functional ethylenically unsaturated monomer, and
from 0 to 10 mole percent of a diethylenically unsaturated monomer or polyfunctional mercaptan;
wherein said amine-functional monomer is not a quaternized amine, and wherein said copolymer is at least 75 mol % neutralized with an organic acid.

10. The fibrous material of claim 9 wherein said fibrous substrate is selected from the group consisting of textiles, woven fabrics, knit fabrics, and carpet.

11. The fibrous material of claim 9 wherein said copolymer further comprises from 0 to 20 mole percent of an acid functional monomer.

12. The fibrous material of claim 9 wherein said copolymer further comprises from 0 to 10 mole percent of a hydroxy, alkyl or aromatic capped poly(alkoxylated) monomer.

13. The fibrous material of claim 11 wherein said protective coating improves color retention of fibrous material when compared to fibrous material without the protective coating.

* * * * *